United States Patent [19]

Finlayson, III et al.

[11] 4,351,638

[45] Sep. 28, 1982

[54] PROCESS OF REACTIVELY DYEING AND PRINTING TOWELING

[75] Inventors: James E. Finlayson, III, Winston-Salem; Joseph P. Holder, Greensboro; L. Earl Holt, Burlington, all of N.C.; Seung Y. Lee, Rochester, N.Y.

[73] Assignee: Burlington Industries, Inc., Greensboro, N.C.

[21] Appl. No.: 304,042

[22] Filed: Sep. 21, 1981

[51] Int. Cl.[3] ..... D06P 5/15; C09B 62/00

[52] U.S. Cl. ..... 8/463; 8/455; 8/543; 8/548; 8/585; 8/586; 8/918

[58] Field of Search ..... 8/463, 455, 548, 585, 8/586

[56] References Cited

U.S. PATENT DOCUMENTS

| | | | |
|---|---|---|---|
| 4,098,784 | 7/1978 | Swidler et al. | 260/199 |
| 4,111,648 | 9/1978 | McConnell et al. | 8/586 |
| 4,134,722 | 1/1979 | Swidler et al. | 8/541 |
| 4,150,020 | 4/1979 | Swidler et al. | 260/200 |
| 4,171,954 | 10/1979 | McConnell et al. | 8/603 |

FOREIGN PATENT DOCUMENTS 1512321 6/1978 United Kingdom .

OTHER PUBLICATIONS

Research Disclosure (Anon.) Apr. 1977 (pp. 85–86) No. 15657.

Maxtract, Product Bulletin, Stowe-Woodward Co., Jul. 25, 1975.

*Primary Examiner*—A. Lionel Clingman

*Attorney, Agent, or Firm*—Cushman, Darby & Cushman

[57] ABSTRACT

Cotton-containing toweling is dyed in a dye bath solution containing a coloring amount of at least one phosphonic acid fiber reactive dye together with sufficient acids such that the fiber reactive dye reacts with and attaches to the cotton of the toweling. The deybath-saturated toweling is passed through a high expression roll until the wet pickup is in the range of about 40–55 percent wpu, and then the toweling is heated to a temperature of at least 200 degrees F. for a time sufficient to fix the dye onto the cotton producing a fully penetrated, evenly dyed toweling. The toweling may be printed in a predetermined pattern with a print paste after passage through a high expression roll and before final heating.

14 Claims, 2 Drawing Figures

HIGH EXPRESSION ROLL
PAD BATH
INFRARED PREDRYER
STEAM CANS
SEMI CONTACT THERMOSOL OVEN
WASHERS
STEAM CANS

PROCESS OF REACTIVELY DYEING AND PRINTING TOWELING

The invention relates to the dyeing of textiles and specifically to the reactive dyeing of cotton or cotton blend toweling and to the printing of reactively dyed toweling.

Terry cloth for toweling is commonly constructed of a base fabric made from a polyester/cotton blend to give strength, while the loop yarns, either singles yarns or plied yarns, are 100% cotton. There are three possible combinations: singles yarns on both sides of the fabric; plied yarns on both sides of the fabric; and singles yarns on one side with plied yarns on the other side of the fabric. The loops may be cut or uncut, depending on the effect desired; the base fabric may be 100% cotton.

Being primarily constructed of 100% cotton, toweling is conventionally dyed, usually in rope form with vat dyes, naphthol dyes or conventional alkali-fixing reactive dyes. Indeed, for many years toweling has been dyed with vat dyes because of their high fastness properties, particularly their resistance to chlorine bleaching. The vat dyeing system is often referred to as a "wet" dyeing system. According to this sytem the dry fabric is contacted or "padded" with the vat dye in pigment form, squeezed to remove a portion of the dyebath followed by chemical reduction, steamed to cause the soluble dye to penetrate into the fibers and fix, then oxidized, washed and dried. Thus, the fabric remains wet during the dyeing operation. This so-called wet system is conventionally used even today and produces a very uniform, evenly dyed towel.

More recently, conventional alkali-fixing reactive dyes have been used for certain colors because of their bright shades and lower costs. This process is also a "wet" system similar to the vat pigment application—that is, the dry fabric is padded with the reactive dye bath, followed by steaming for fixation, and then the fabric is washed and dried. The chemical reduction/oxidation steps used in the vat process are not necessary for the reactive dyeing process. However, toweling dyed with reactive dyes is not as stable to chlorine bleach as is vat dyed toweling. Therefore, a reactively dyed towel is marked with a "do not bleach" label and such a restriction is accepted in the marketplace.

Phosphonic acid reactive dyes, a specific and unique class of fiber reactive dyes, have one or more phosphonic groups thereon which chemically bond and fix to the cellulosic fiber under acid conditions, hence are sometimes termed acid-fixing. These phosphonic acid dyes are both efficient and economical in dyeing cellulosic fabrics. However when these dyes are applied to terry toweling, unwanted dye migration occurs unless special procedures are used.

We have found that terry toweling evenly dyed, acceptable in appearance and handle, is prepared by using phosphonic acid fiber reactive dyes in which special procedures are used to assure dyebath penetration along the pile and almost complete freedom from dye migration prior to fixation of the dye onto the cotton of the toweling. These acid-fixing phosphonic acid dyes are available to and known in the trade as Procion T reactive dyes (trademark of Imperial Chemical Industries, Ltd.) and are applied to the toweling using special procedures and equipment, dried and then thermosol fixed to produce the evenly dyed dyed product as hereinafter described.

Phosphonic acid reactive dyes of the type specified and used in the procedures of our invention are more efficient and hence more economical in the dyeing of toweling than are the vat dyes. Accordingly, it is an object of our invention to produce evenly dyed toweling at a reduced cost using the fiber reactive phosphonic acid dyes.

The conventional method of applying a vat dye is by the pad method, in which the toweling is immersed in the dyebath and then squeezed between two contacting rolls which reduce the pickup of liquor to an amount in the range of 70–80% on weight of fabric. We have found when padding a phosphonic acid reactive dye that a wet pickup in this range does not produce a satisfactorily dyed towel. After the drying step the loops are not uniformly dyed and the middle, underlying fabric is not fully dyed, as is apparent when the loops are parted. It is believed that this results from migration of the soluble phosphonic acid dyes to the surface as water is removed in drying.

The specific dyeing procedure of our invention reduces fiber reactive dye migration in the toweling by passing the dye-containing fabric through a high expression roll which roll significantly reduces the wet pickup of the toweling from the customary 70–80%, as with vat dyeing, down to about 48–55% or so. Even prior to drying, the high expression roll seems to achieve more even penetration of the dye throughout the entire toweling than do conventional pad rolls. More importantly, with less water pickup there is much less migration of the dye during drying, continued uniformity of dye distribution is achieved, and an evenly dyed final product results.

High expression rolls of the type used in the process of our invention are sometimes known as high intensity nip rolls or high performance extraction rolls. Such rolls typically have a somewhat resilient covering over one or both of a pair of opposed steel rolls; in the specific examples of our invention a hard polyurethane cover of low compressibility was used on one of the rolls, while the other roll was steel alone. The rolls, pressed together under high pressure, are used in textile finishing processes to remove larger than usual amounts of liquid from goods passed between them. Pairs of urethane-coated rolls could also be employed together.

In the process of our invention, the toweling is padded in open width with a dye-bath containing a fiber-reactive phosphonic acid dye or dyes together with ammonium dihydrogen phosphate, a cyanamide such as dicyandiamide, a wetting agent and a thickener. The somewhat viscous dyebath is applied to the toweling by padding using a high expression roll which reduces the wet pickup from the usual 70–80% to 45–55% wet pickup. The toweling preferably is then predried on an infrared unit; drying is completed on steam cans. Following the steam cans, the toweling is themosoled in a roller or semi-contact type oven to fix the fiber-reactive dye onto the cotton of the toweling. Any unfixed dye is then washed off in dolly washers or other similar washers, in open width or rope form.

A towel dyed by our process is level and fully penetrated by the dye. This is an unexpected result since the phosphonic acid-type reactive dyes used are water soluble and with conventional pad rolls migrate to the outside of the fibers and yarns away from the woven base. It appears that by using the high expression roll to lower the wet pickup to about 45 to about 55% the amount of water is reduced to the point that removal of the remaining water by the subsequent drying steps in the infrared unit and in the steam cans does not result in perceptible dye migration. The pressure exerted by the high expression rolls also causes the dye to be more uniformly distributed throughout the fibers and yarns of the toweling.

The dyebath also includes an acid or acid-reacting substance to lower the pH so that the phosphonic acid reactive dye(s) contained in the dyebath react with the hydroxyl groups of the cotton and attach themselves chemically to the cotton. While the pH may range from acidic to mildly alkaline, i.e. pH 1.5 to 9, the pH of the dyebath is generally in the area of about 5 to about 6. A cyanamide condensing agent is also included in the dyebath; suitable compounds include cyanamide, dicyandiamide, alkyl-substituted cyanamides, and alkyl-substituted dicyandiamides, the alkyl group having from 1 to 6 carbon atoms. Usually in the dyebath the molar ratio of the cyanamide to each phosphonic acid function is at least about 2:1. Curing is generally conducted at a temperature of at least 200° F. and generally below 400° F. Preferably the toweling is preliminarily dried before curing at a temperature below 200° F. Cure times, which will vary depending upon temperature, dye concentration and the like, are readily determined by the skilled operator.

The dyebath containing the phosphonic acid dye preferably also contains a thickener/antimigrant that is compatible with the dye system and prevents movement of the dye towards the outer ends of the fibers and yarns. Suitable materials include the polyacrylic acids, alginates, and natural gums such as locust bean gum. Preferred antimigrants are: Carbopol 801 thickener (measured herein in parts of a 5% solution of polyacrylic acid of approximately 450,000 molecular weight, made by B. F. Goodrich), the polyacrylic acid antimigrants being particularly effective in acid media; and Kelgin LV (particularly suited for alkaline print pastes for "conventional" fiber-reactive dyes that attach to cellulose under alkaline conditions) which is a sodium alginate polysaccharide colloid sold by Kelco Division of Merck & Co., Inc., Clark, New Jersey. Kelgin LV is described by the manufacturer as having a Brookfield viscosity of 1,600 cps when a 5% stock solution mixed with an equal volume of water is measured at 70° F. on the 100 scale, LVF Model, with No. 4 spindle at 60 RPM.

The amount of thickener/antimigrant included in the dyebath varies with the dye system employed as well as the characteristics of the toweling being dyed. The dyebath may also contain minor amounts of conventional additives or assistants such as Glauber's salt or wetting agents.

Towels are sold in the marketplace in either white, solid colors, or with patterns printed on either white or colored backgrounds. In conventional printing of towels, toweling is commonly first background-dyed in continuous form, except when the background is to be white, before the final towels are made. From this toweling, whether white or colored, individual towels are cut and hemmed, fringed, treated with softeners or the like, or otherwise put in finished form and condition. The individual towels, in groups of one to four, depending on their size, are placed by hand on a flat bed press and printed, most commonly with pigments, and finally dried, to complete the process. The printed towels feel rather stiff and harsh in the printed area. In addition to being labor intensive, this procedure also limits the colors or color combinations that may be used—for printed pigment to be seen it is necessary that the pigment be darker than the background color, thus restricting the styles available to dark-on-light combinations.

Another aspect of our invention includes printing of terry toweling in an economical and attractive manner. Printing is among several processes used by the textile industry and many colors can be applied simultaneously to make a design on the fabric. The design may be simple or very involved depending on the desired effect one wants to obtain. The actual printing of the fabric is done with a roller type or rotary screen machine, again depending on the type equipment available. One special type of printing that has been used for many years is discharge or resist printing. Discharge printing or resist printing involves either destroying or resisting the fixation of a dyestuff that has been applied as a background color to the fabric. The print paste in such a procedure thus contains a chemical that will destroy or resist the dye that has been applied as a background color. The background color may be applied prior to or subsequent to the discharge paste and may be applied by padding, printing, or dyeing. The printed area may be left white or a color may be added. The color used in the discharge paste must be stable to the chemical used to discharge or resist the dyes in the background shade.

The present invention relates also to the production of a discharge print on toweling utilizing a phosphonic acid reactive dye system (acid fixing) as herein described and the "normal" alkali fixing reactive dyes. By normal or conventional fiber reactive dyes we mean those dyes which will form a covalent link with cellulose under alkaline conditions as described in Beech, Fibre-Reactive Dyes, Logos Press Ltd. (1970), the disclosure of which is hereby incorporated by reference. Preferred are the monochlorotriazinyl dyes such as the Procion H type. The dichlorotriazinyl Procion M, trichloro-pyrimidyl, and like dyes may be used but the sulfatoethylsulfone dyes should be avoided.

The phosphonic acid dyes, described in U.S. Pat. No. 4,134,722, the disclosure of which is hereby incorporated by reference, are fixed in the presence of cyanamide or dicyandiamide under slightly acidic conditions. The phosphonic acid group reacts with the hydroxyl groups on the cellulose (cotton) toweling to form a dyed substrate having a phosphonate ester linkage between the chromophore and the cotton substrate. When the conditions are changed to alkaline, however, these phosphonic acid fiber reactive dyes do not readily fix or react with cellulose to become immobilized. Since the conventional fiber reactive dyes are fixed under strongly alkaline conditions, the phosphonic acid reactive dyes may be discharged or resisted by overprinting with one or more of these regular reactive dyes containing the alkali necessary for their fixation.

Thus, in the printing aspect of our invention an alkaline print paste with or without a conventional fiber reactive dye is printed in a desired design on toweling which has been background dyed with one or more phosphonic acid dyes according to the dyeing aspect of the invention, except that the background color has not yet been set by heating. If a white design is wanted, there is no conventional fiber reactive dye in the print paste. If a colored design is wanted, suitable conventional fiber reactive dye(s) is present in the print paste. For example, the phosphonic acid reactive dyes are used as the background shade and are padded on the towel fabric open width prior to printing with the regular alkaline fixing dyes mentioned above. After padding the toweling is passed open width through a high expression roll to reduce the wet pick-up to about 45–55%, then preferably predried and dried, as in the dyeing embodiment of our invention as described above. No heat fixation is used.

Although, for easier control of potential migration, predrying and drying prior to printing are preferred, it will be obvious to one of ordinary skill in the printing art that with proper adjustment of thickeners in the background dyebath and/or printing paste the predrying and drying steps can be deferred until after the print paste is applied.

Thus, preferably after but alternatively before predrying and drying, next an alkaline print paste containing an alkali-fixing reactive dye(s) is applied in the desired pattern. The alkali in the print paste prevents fixation of the previously applied acid fixing phosphonic acid reactive dye within the printed design area. The toweling is then heated or thermosoled, in the manner described above in respect of the dyeing embodiment of our invention, under time and temperature sequence conditions suitable to fix the phosphonic acid reactive dye in the background as well as the regular reactive dye in the print area. If no color is desired in the printed area(s) then an alkaline print paste free of fiber reactive dye is used leaving the area thus printed the color of the prepared undyed toweling.

The alkali, with or without alkali-fixing fiber reactive dye as described above, is applied to the desired area(s) by conventional printing methods employing engraved rolls, patterned screens or the like.

Alternatively the conventional alkali-fixing dyes can be used as the background color and the acid fixing phosphonic acid reactive dyes used in a print paste as the print pattern.

It is important that a uniform background color be produced in order for the product to be acceptable. Since the phosphonic acid reactive dyes are very water soluble, after conventional padding they tend to follow the water to the surface of a terry fabric during drying, i.e., migrate. This produces a tip-dyed effect, with color concentrated in the outer two surfaces, and the results are unacceptable. It has been found that this can be prevented by utilizing a high expression roll to control the amount of water in the background area of the terry fabric.

The process of the present invention employs a high-extraction roll such as a Maxtract roll (available from Stowe-Woodward Co.) to reduce water content after dye padding to, say, 45–55% owf, preferably below 50%, thereby achieving a level background dyeing of the terry. Such levelness cannot be achieved at conventional levels of dyebath padding in an acid fixing phosphonic acid reactive dyeing thermosol system.

Background levelness of the fabric is an important aspect of the resulting product and represents the major improvement of the invention compared to dyeings of terry toweling with phosphonic acid reactive dyes employing conventional extraction rolls after padding; that is, without the use of a high expression roll. During the predrying required to prepare the normally-padded reactively dyed background areas for final curing, the phosphonic acid reactive dyes migrate so badly away from the base and along the upstanding terry yarns, as they dry from the surface inwardly towards the base fabric, that the yarn below the surface is left virtually colorless, giving a tip-dyed effect which would not be acceptable in the marketplace.

While conventional reactive-type dyes have been used for towel dyeings, fixing of these dyes on toweling is done by steaming, as contrasted with thermosoling in the dry state as used in our process. Steaming with saturated steam is a wet process, and the toweling never dries out before fixing is complete. On the other hand the phosphonic acid reactive dyes require drying before fixing, and in the absence of special procedures dye migration during drying is so bad that the dyed towels are not acceptable.

DETAILED DESCRIPTION OF THE DRAWINGS

Figure 1:
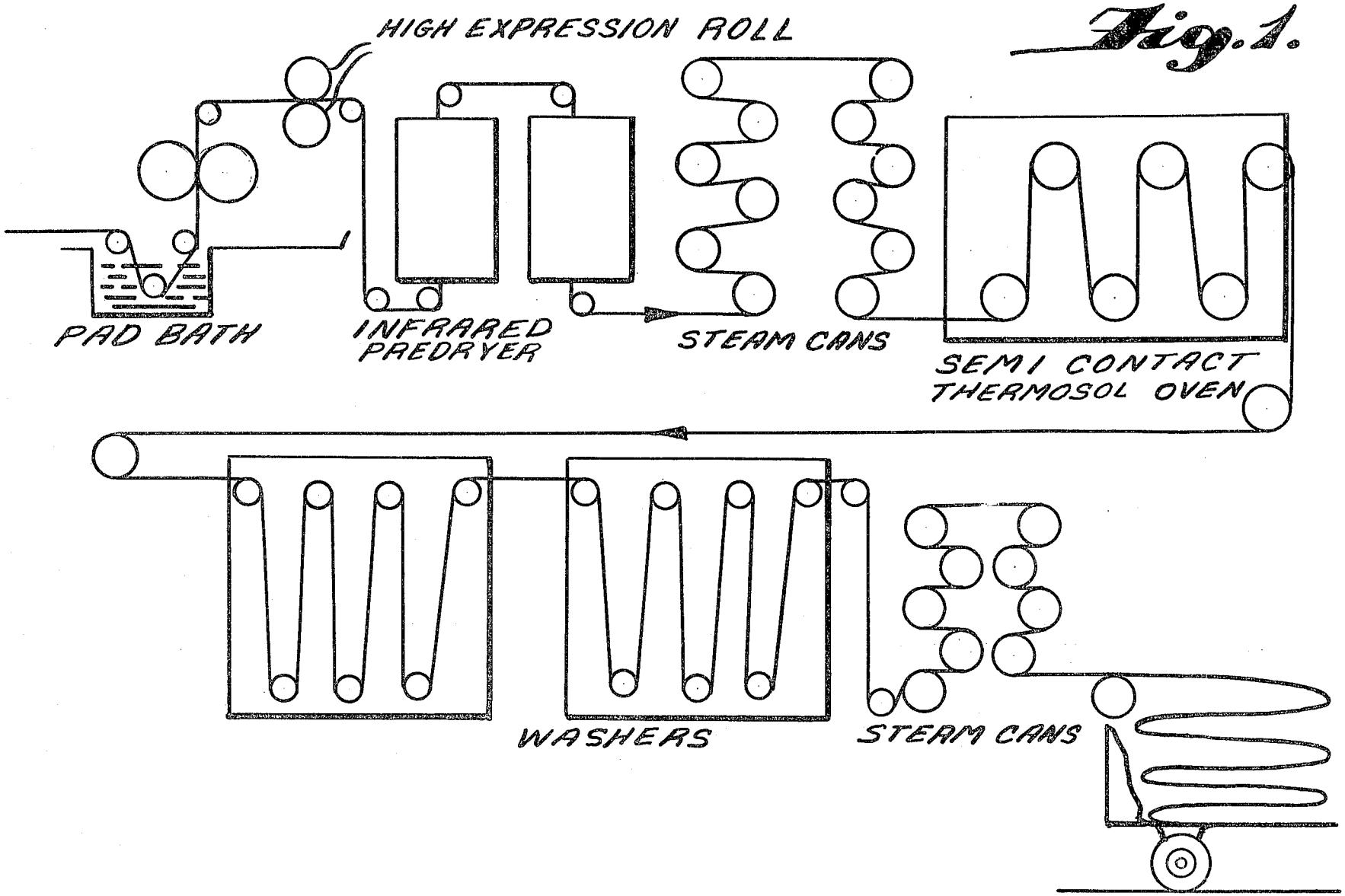

FIG. 1 is a schematic diagram of the process steps of dyeing toweling according to the present invention. The involved equipment is represented schematically and it will be understood that other arrangements and types of equipment may be employed as well.

In a preferred embodiment of the invention a phosphonic acid reactive dye system is applied to the prepared undyed toweling with a wet pickup in the range of about 70–80%. This is done with conventional hard rubber pad rolls. The wet pickup is then reduced by the high expression roll to a value of about 45 to 55%, preferably below 50%, and the moist toweling is then passed through an infrared dryer. The infrared dryer serves to reduce the water content of the toweling to, say, 35 to 40% from the previous 45 to 55%. Drying is then completed on a series of steam cans and then the phosphonic acid fiber reactive dye is fixed in a semi-contact thermosol oven. After fixation the dyed fabric is scoured or washed in suitable washing equipment such as dolly washers or the like to remove any unfixed dye, thickener or the like that may be present in the dye pad system. Final drying is accomplished by another series of steam cans and the dried, fully penetrated and dyed toweling is collected.

Although the use of a predryer is generally preferred, it is not always essential. When the high expression roll is particularly effective, as when it reduces the water content of the toweling to the lowest achievable level, the fabric may often advantageously be passed straight from the high expression roll to the drying cans. Or, inasmuch as the migration tendencies of the various phosphonic acid dyes differ substantially in proportion to their solubilities, not all of the dyes require predrying. It is well within the skill of the art to determine by simple experimentation when predrying is necessary.

The 35–40% water content after predrying cited above is a somewhat arbitrary level, inasmuch as it will vary widely under practical conditions: type of predryer, fabric speed, pile height, pile density, etc. Actually a lower limit such as 25% is entirely possible. This would probably be difficult to achieve in practice, principally because of the risk of overdrying and overheating the pile tips while the pile interior is being dried. Particularly in the printing aspect of the invention this would incur the risk of prematurely setting the background dye within the print areas.

In addition, although it is generally preferred that the high expression roll be used in succession after conventional pad rolls, it is often possible to dispense with the pad rolls. In this case the toweling proceeds directly from the dyebath to the high expression rolls. Dye liquor expressed by either or both sets of rolls flows by gravity back to the dyebath.

It is largely a matter of convenience or manufacturer's choice whether the pad rolls and high expression rolls be placed as shown in FIG. 1, i.e., horizontally and vertically, or in other orientations of choice.

Figure 2:
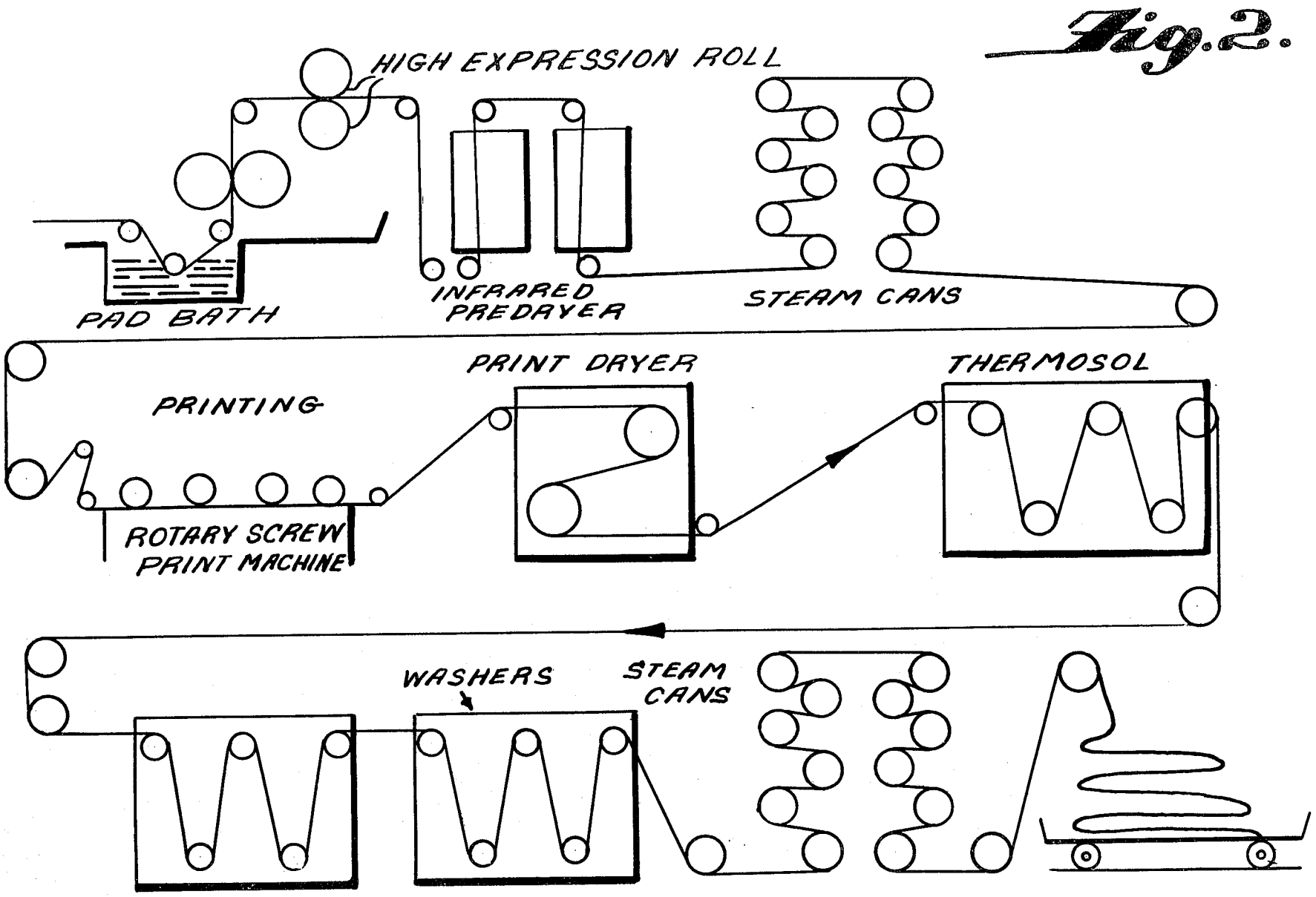

In another embodiment of the invention, as shown in FIG. 2, the background color of the fabric is applied in step 1 in the same manner as described above. The high expression roll reduces the wet pickup to about 45 to about 55%, preferably below 50%, and the fabric preferably is passed through an infrared dryer to further reduce the water content to about 35 to 40%. Drying is completed on a series of steam cans and the fabric as it emerges from the steam cans is completely dry and preferably has not been heated in excess of 200° F. For convenience a thermosol cabinet or oven may be left in line, but heat is not applied to the device and the material is led through the thermosol oven while the oven is in the cold state, in order not to fix the dye prematurely.

The next step is printing of the desired pattern or design onto the background color preferably using a rotary screen print machine. The print paste employed uses a conventional fabric reactive dye which fixes to the cotton fabric under alkaline conditions. Next the printed fabric is led to a print dryer to dry the print paste and then through a semicontact thermosol oven to complete fixation.

A third series of steps involves washing of the fabric to remove any unfixed dye, thickener or other component of the dye pad system or the print paste present on the fabric, after which the printed and dyed fabric is dried on a series of steam cans and collected.

The print paste may contain only an alkali to prevent fixation of the acid-fixing fiber reactive dye applied in the dye bath. Alternatively, the print paste may also contain, in addition to the alkali, an alkali-fixing conventional fiber reactive dye. The use of an overall background color for the toweling provided by the phosphonic acid reactive dye together with resist printing of an alkaline print paste or alkali-fixing conventional fiber reactive dye allows for a wide variety of color combinations. For instance, a light color may be printed onto a dark background. Using conventional procedures it was only possible to print a darker color onto a lighter colored background. Further variations will be appreciated by one skilled in the art.

The high expression or high extraction roll, as it is sometimes called, is a known piece of equipment for textile finishing. The roll employed in the following examples, Maxtract, was a polyurethane-covered, 60 Shore D hardness roll operating against a steel roll.

The invention will now be further illustrated in the following specific examples of practice. It is to be understood that these examples are presented solely for purposes of illustration and not by way of limitation; alternative materials may readily be substituted without departing from either the spirit or scope of the invention.

EXAMPLE 1

A dyebath is prepared containing the following ingredients:

| | |
|---|---|
| dicyandiamide | 4.0 parts |
| ammonium dihydrogen phosphate | 0.3 parts |
| Carbopol 801 thickener | 7.0 parts |

-continued

| | |
|---|---|
| nonionic surfactant | 0.2 parts |
| Yellow Dye I 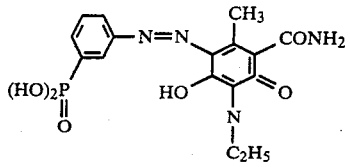 | 0.55 parts |
| Yellow Dye II 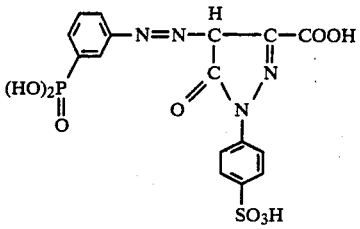 | 0.75 parts |
| water | 87 parts |

Processing is as shown in FIG. 1. The dyebath so prepared is padded on terry cloth, having singles yarn on one side and plied yarns on the other, with a high expression roll to a wet pick-up of 47%, dried in an infrared dryer, thermosoled for 80 seconds at 216° C., washed in hot water containing soda ash and nonionic detergent and finally dried. A fully penetrated dyed towel of a yellow color is obtained.

EXAMPLE 2

A dyebath is prepared containing the following ingredients:

| | |
|---|---|
| dicyandiamide | 4.0 parts |
| ammonium dihydrogen phosphate | 0.3 parts |
| Carbopol 801 thickener | 7.0 parts |
| nonionic surfactant | 0.2 parts |
| Yellow Dye II 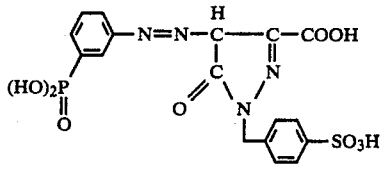 | 3.87 parts |
| Red Dye I 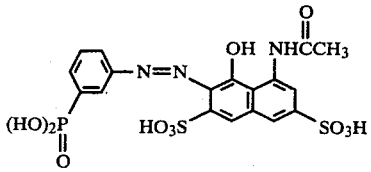 | 9.61 parts |
| Blue Dye I 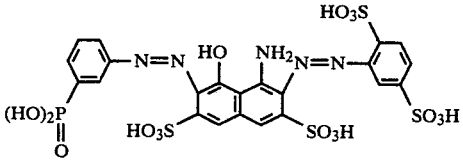 | 2.95 parts |
| water | 72 parts |

The dyebath is padded on terry cloth and processed in the manner of Example 1. A dark red towel with an evenly dyed appearance was obtained.

EXAMPLE 3

A dyebath is prepared containing the following ingredients:

| | |
|---|---|
| dicyandiamide | 4.0 parts |
| ammonium dihydrogen phosphate | 0.3 parts |
| Carbopol 801 thickener | 7.0 parts |
| nonionic surfactant | 0.2 parts |
| Yellow Dye II | 4.63 parts |
| Blue Dye I | 2.16 parts |
| Red Dye I | 5.07 parts |
| water | 77 parts |

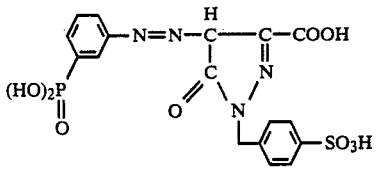

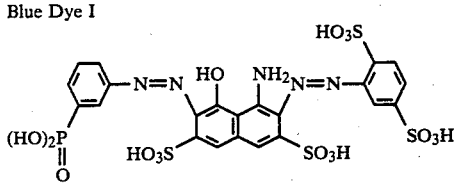

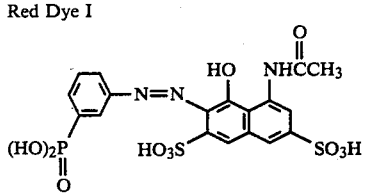

The thus prepared bath is padded on terry and treated in the manner of Example 1. A brown evenly dye towel with a satisfactory appearance was produced.

EXAMPLE 4

A dyebath consisting of the following ingredients was prepared:

| | |
|---|---|
| Procion Scarlet TG | 1.47 parts |
| Procion Violet T-BRA | 2.94 parts |
| Procion Yellow TR | 8.4 parts |
| dicyandiamide | 4.0 parts |
| ammonium dihydrogen phosphate | 0.3 parts |
| Carbopol 801 thickener | 7.0 parts |
| Synthrapol WNK (nonionic surfactant) | 0.2 parts |
| water | 76 parts |

The above dyebath is padded on terry cloth using a high expression roll to a wet pick-up of 49%, predried in an infrared unit and then dried on steam cans. The cloth is then thermosoled eighty seconds at 216° C. Washing out the unfixed dye on a dolly washer produces a level dyed towel equal in appearance and hand to a vat dyed towel.

EXAMPLE 5

Towel fabric prepared for dyeing is padded with a bath containing:

| | |
|---|---|
| dicyandiamide | 4 parts |
| ammonium dihydrogen phosphate | 0.3 parts |
| Carbopol 801 thickener | 7.0 parts |
| nonionic surfactant | 0.2 parts |
| antifoam | 0.06 parts |
| Blue Dye I | 1.76 parts |
| Yellow Dye II | 1.95 parts |

Processing is as shown schematically in FIG. 2. A high expression polyurethane roll yields a wet pickup of 53%, after which the fabric is predried with infrared type units and then fully dried on steam cans. The thus dried fabric is transferred to a Stork rotary screen printer where a pattern containing stripes of different colors, as well as a white stripe, is printed over the background shade.

The print pastes used in the printing are prepared as follows: The stock base, termed print clear, used in most of the following examples is:

| | |
|---|---|
| sodium bicarbonate | 10 parts |
| urea | 20 parts |
| Kelgin LV | 4 parts |
| water | 66 parts |

| Blue print paste | | Red print paste | |
|---|---|---|---|
| print clear | 70 parts | print clear | 70 parts |
| Procion Blue H-5G | 1 parts | Procion Scarlet HRN | 5 parts |
| water | 29 parts | water | 25 parts |
| (10 lbs pressure) | | (8 lbs pressure) | |

| Yellow print paste | | Black print paste | |
|---|---|---|---|
| print clear | 70 parts | print clear | 70 parts |
| Procion Yellow H-4G | 5 parts | Procion Yellow H-4G | 3.5 parts |
| (CI Reactive Yellow 18) | | Procion Blue H-5G | 3.5 parts |
| Procion Scarlet HRN | 0.02 part | Procion Scarlet HRN | 0.1 part |
| (CI Reactive Red 33) | | water | 23 parts |
| water | 25 parts | (10 lbs. pressure) | |
| (12 lbs. pressure) | | | |

| White print paste | |
|---|---|
| print clear | 70 parts |
| caustic soda | 10 parts |
| water | 20 parts |
| (15 lbs. pressure) | |

The pressure, expressed in pounds for each of the above print pastes, reflects the pressure on the squeegee that pushes the print paste through the print screen.

The Brookfield viscosities (Model RVF, #5 spindle, 20 rpm) of the above pastes ranges from 2500–4000 cps.

The above colored pastes are next printed on the predyed and dried towel fabric on a Stork rotary screen machine at 10 ypm using a #40 blade and pressure settings shown under the print pastes above. The dryer temperature is set at 370° F. (2 min. dwell time) and the cure oven is set at 350° F. (15 min. dwell time).

The dyed and printed fabric is then scoured in a dolly washer using soda ash and a nonionic detergent. The final fabric, having red, blue and yellow stripes with a white outline on a very level green background, has fully acceptable wetfastness and hand.

EXAMPLE 6

In this example terry fabric is printed first with two alkali-fixing reactive dyes (Procion H type) and then padded with acid-fixing phosphonic acid reactive dye (Procion T type). The background dye is resisted in the alkaline print area.

A print clear of the following formula is prepared:

| | |
|---|---|
| Kelgin LV | 4 parts |
| urea | 20 parts |
| water | 76 parts |

From this the print colors are made as follows:

| | | |
|---|---|---|
| A. | sodium bicarbonate | 5 parts |
| | Procion Violet H-34 (CI Reactive Violet 1) | 0.5 parts |
| | print clear | 95.5 parts |
| B. | sodium bicarbonate | 5 parts |
| | Procion Yellow HE-4R (CI Reactive Yellow 84) | 1 part |
| | print clear | 94 parts |

The colored pastes are printed on terry fabric on a Stork rotary screen machine at 10 ypm using a #40 blade at 15 psi pressure. The fabric is then dried and cured at 187° C.

The printed fabric is then padded with the following dye solution:

| | |
|---|---|
| Procion Turquoise T-2G (CI Reactive Blue 174) | 8 parts |
| dicyandiamide | 4 parts |
| ammonium dihydrogen phosphate | 0.3 part |
| Carbopol 801 | 7.0 parts |
| nonionic surfactant | 0.2 parts |
| antifoam | 0.06 parts |
| water | 80 parts |

A high extraction roll yields a wet pickup of 48%, after which the fabric is predried and thermosoled for 80 seconds at 216° C.

The dyed and printed fabric is then scoured on a dolly washer using soda ash and a nonionic detergent. The final fabric has yellow and violet designs on a fully dyed turquoise background with acceptable hand and wetfastness properties and a level background color on both face and back of the terry cloth.

EXAMPLE 7

Towel fabric prepared for dyeing is padded with a bath containing the following:

| | |
|---|---|
| dicyandiamide | 4.0 parts |
| ammonium dihydrogen phosphate | 0.3 parts |
| Carbopol 801 | 7.0 parts |
| nonionic surfactant | 0.3 parts |
| Yellow Dye II | 3.0 parts |
| water | 85.4 parts |

A high extraction roll yields a wet pickup of 48% after which the fabric is predried with infrared lamps and fully dried in a Benz unit, being careful not to allow the fabric temperature to go above 250° F. The thus dried fabric is then printed with a stripe on a laboratory unit. The print paste used is as follows:

| Green print paste | |
|---|---|
| print clear of Example 5 | 70 parts |
| CI Reactive Yellow 1 (CI 18971) | 5 parts |
| CI Reactive Blue 4 (CI 61205) | 2 parts |

The printed fabric is then thermosoled at 400° F. for 90 seconds on a Benz unit. The fabric is then scoured in hot water containing soda ash and a nonionic detergent. The resulting fabric has a very level yellow background and a green stripe with good appearance and wetfastness.

EXAMPLE 8

The prepared towel fabric is dyed and dried as in EXAMPLE 7, except the dyebath contains:

| | |
|---|---|
| Red Dye I | 2 parts |
| Yellow Dye II | 4 parts |
| Blue Dye I | 0.2 parts |

After padding and drying as in Example 7, the fabric is printed with the following:

A. Print clear as in Example 5 except 10 parts sodium carbonate substituted for sodium bicarbonate.

B. Blue paste

| | |
|---|---|
| print clear | 70 parts |
| CI Reactive Blue 5 (CI 61210) | 2 parts |
| water | 28 parts |

The printed fabric is then thermosoled and scoured as in Example 7. The towel fabric has a level reddish-brown background with a blue stripe.

EXAMPLE 9

As in Example 7 except the print paste contained 3 parts CI Reactive Red 17 (CI 18155). The resulting towel has a level yellow background with a red stripe.

EXAMPLE 10

The towel fabric prepared for dyeing is padded with a bath containing:

| | |
|---|---|
| dicyandiamide | 4.0 parts |
| ammonium dihydrogen phosphate | 0.3 parts |
| nonionic wetting agent | 0.2 parts |
| modified corn starch anti-migrant | 6.8 parts |
| Red Dye I | 1.95 parts |
| Yellow Dye II | 3.9 parts |
| Blue Dye I | 0.19 parts |
| water | 82.7 parts |

A high-extraction polyurethane roll produces a wet pickup of 52%, after which the fabric is predried with infrared type units and then fully dried on steam cans. The thus dried fabric is then transferred to a Stork rotary screen printer where a pattern of different colored squares, one within the other, is printed over the background shade. The print pastes are prepared as in Example 5 and contain the following amounts of dye:

| Red | | Orange | |
|---|---|---|---|
| Procion Red H-3BN | 2 parts | Procion Red H-3BN | 1 part |
| Procion Yellow H-4G | 3.5 parts | Procion Yellow H-4G | 8 parts |

-continued

| Yellow | | Green | |
|---|---|---|---|
| Procion Yellow H-4G | 10 parts | Procion Blue H-GR | 0.3 part |
| Procion Blue H-5R | 0.03 parts | Procion Yellow H-4G | 1.0 part |
| | | Procion Turquoise H-7G | 0.4 part |
| **Blue** | | **Violet** | |
| Procion Blue HGR | 1.5 parts | Procion Violet H3R | 1.0 part |

The above pastes are printed on the predyed towel, dried, and cured as in Example 5.

Following this the towel fabric is scoured in a dolly washer using soda ash and a nonionic detergent. The final fabric has different colored squares, one within the other, on a level brown background with acceptable wetfastness and hand.

What is claimed is:

1. A process of dyeing cotton-containing toweling comprising the successive steps of:

(a) applying to a cotton or cotton-containing toweling a dyebath solution containing a coloring amount of at least one phosphonic acid fiber reactive dye together with sufficient acid such that the fiber-reactive dye reacts with and attaches to the cotton of the toweling;

(b) passing the dyebath-saturated toweling from step (a) through a high expression roll until the wet pickup is in the range of about 45 to about 55% wpu;

(c) heating the dyebath-containing toweling of step (b) to a temperature of at least 200° F. for a time sufficient to fix the dye onto the cotton thereby producing a fully penetrated, evenly dyed toweling.

2. A process as claimed in claim 1 wherein prior to heating step (c) the dyebath-containing toweling is dried to reduce the moisture content thereof.

3. The process as claimed in claim 2 wherein the drying is conducted at a temperature less than about 200° F.

4. The process as claimed in claim 1 wherein the heating/fixation step (c) is conducted in the range of about 200° F. to about 400° F.

5. The process as claimed in claim 1 wherein the wet pickup of the dyebath solution is about 70% to about 80% wpu.

6. The process as claimed in claim 1 wherein the toweling is 100% cotton.

7. The process as claimed in claim 1 wherein the towelling is a blend of a major amount of cotton and a minor amount of a non-cellulosic fiber or fibers.

8. A process of dyeing and printing cotton toweling comprising the successive steps of:

(a) contacting cotton toweling with a dyebath containing a cyanamide compound and a coloring amount of at least one phosphonic acid fiber reactive dye such that the dye will react with and attach to the cotton toweling;

(b) passing the dyebath saturated toweling contacted in step (a) through a high expression roll and reducing the wet pickup of the toweling to about 45% to about 55% wpu;

(c) heating the toweling of step (b) at a temperature below the phosphonic acid dye fiber fixation temperature to at least partially dry the toweling;

(d) printing the toweling of step (c) in a predetermined pattern with a print paste containing alkali in an amount sufficient to prevent fixation of the phosphonic acid dye in the area to which the print paste is applied;

(e) drying the printed toweling of step (d); and (f) heating the printed, dried toweling to a temperature of at least 200° F. to fix the phosphonic acid reactive dye onto the cotton, thereby producing an evenly background-dyed printed toweling.

9. The process as claimed in claim 8 wherein the print paste contains an alkali-fixing fiber reactive dye.

10. The process as claimed in claim 8 or 9 wherein the dye containing toweling is substantially completely dried in step (c).

11. The process as claimed in claim 8 or 9 wherein the dye fixation step is conducted at a temperature in the range of 200° F. to about 400° F.

12. The process as claimed in claim 8 or 9 wherein the wet pickup of the dyebath solution in step (a) is about 70% to about 80% wpu.

13. The process as claimed in claim 8 or 9 wherein the dyebath is contacted with the toweling and the wet pickup is reduced on the high expression roll.

14. A process of dyeing and resist printing cotton toweling comprising the successive steps of:

(1) contacting cotton toweling with a dyebath containing a cyanamide compound and a coloring amount of at least one phosphonic acid fiber reactive dye such that upon heating the dye will react with and attach to the cotton toweling;

(2) passing the dyebath saturated toweling contacted in step (1) through a high expression roll and adjusting the wet pickup of the toweling to about 45% to about 55% wpu;

(3) heating the toweling of step (2) at a temperature below the phosphonic acid dye fiber fixation temperature to at least partially dry the toweling;

(4) printing the toweling of step (3) in a predetermined pattern with a print paste containing an alkali-fixing fiber reactive dye and alkali in an amount sufficient to prevent fixation of the phosphonic acid dye in the area to which the print paste is applied;

(5) drying the printed toweling of step (4); and (6) heating the printed, dried toweling to a temperature of at least 200° F. to fix the phosphonic acid reactive dye and the alkali fixing fiber reactive dye onto the cotton, thereby producing an evenly background-dyed, printed toweling.

* * * * *